United States Patent [19]

Spinner

[11] 3,985,418

[45] Oct. 12, 1976

[54] H.F. CABLE SOCKET

[76] Inventor: Georg Spinner, Erzgiebereistr. 33, 8 Munich 2, Germany

[22] Filed: July 12, 1974

[21] Appl. No.: 488,013

[52] U.S. Cl. ..... 339/177 R

[51] Int. Cl.[2] ..... H01R 17/04

[58] Field of Search ..... 339/177 E, 177 R, 95 R, 339/95 A, 94 C, 97 R, 268 R, 268 S, 89 C; 174/75 C, 88 C

[56] References Cited

UNITED STATES PATENTS

| | | | |
|---|---|---|---|
| 2,757,351 | 7/1956 | Klostermann | 339/177 R |
| 3,498,647 | 3/1970 | Schroder | 339/177 R |
| 3,686,623 | 8/1972 | Nijman | 339/177 E |
| 3,846,738 | 11/1974 | Nepovim | 339/177 R |
| 3,854,789 | 12/1974 | Kaplan | 339/177 R |
| 3,879,102 | 4/1975 | Horak | 339/177 R |

*Primary Examiner*—Roy Lake
*Assistant Examiner*—Neil Abrams
*Attorney, Agent, or Firm*—Ralf H. Siegemund

[57] ABSTRACT

A tubular clamping cone with axial split is placed on a coaxial cable and is engaged by a clamping annulus with conical inner surface, the latter element being slidably disposed in a sleeve and urged by springs onto the clamping cone. A socket element is threaded into the sleeve and has an O-ring to urge the cone towards the annulus when the socket element is threaded into the sleeve and makes contact with the outer conductor of the cable.

8 Claims, 1 Drawing Figure

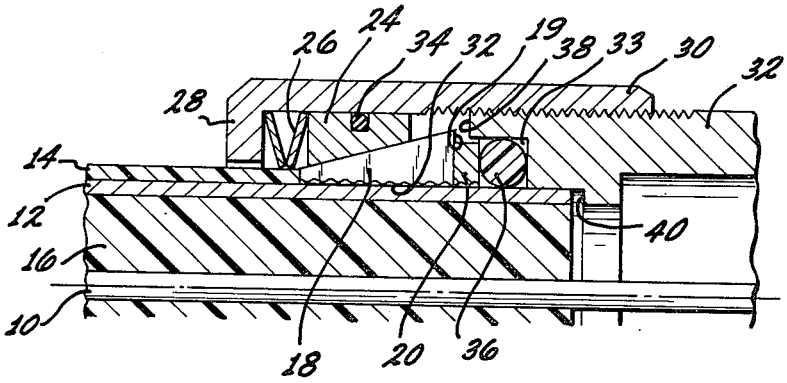
26
24
34
32
19
38
33
30
32
28
14
12
16
10
40
18
20
36

H.F. CABLE SOCKET

BACKGROUND OF THE INVENTION

The present invention relates to a connector element and socket for connection to a coaxial cable.

Coaxial cables have inner and outer conductors separated by a dielectric spacer. The outer conductor is frequently constructed as a thin-walled tube, such as an aluminum tube. Such a conductor is strong but a thin wall may pose specific problems for termination. If a fitting, connector socket, plug or the like is to be connected to the end of such a cable the problem arises of fastening the connector element sufficiently secure to the cable. Particularly, in the case of thin-walled aluminum tubes as outer conductors, the problem arises that radially effective clamping pressure exerted by the connector element produces cold flow of the conductor material tending to loosen the fit of the connector element on the cable. Changes in ambient temperature further that process.

DESCRIPTION OF THE INVENTION

It is an object of the present invention to provide a connector element such as a connector socket, plug or other fitting, which can be secured to the end of a coaxial cable and remains secured thereto. Particular changes in temperature should not loosen the connection, and, generally, the connection should not become less secure with the passage of time.

In accordance with the preferred embodiment of the invention, it is suggested to provide a resiliently biased annulus having a conical inner surface and coacting with a conical, tubular clamping member for clamping the latter onto the cable. The annulus is situated inside of a sleeve, and the clamping member is interposed between the annulus; a socket element is threaded into the sleeve.

The clamping member provides radially inwardly directed clamping pressure onto the cable to which it is secured. If the material of the outer conductor flows under clamping pressure, resilient bias on the annulus will offset any tendency to loosen the fit, so that the conical clamping member continues to be clamped on the cable.

The sleeve is preferably provided with a flange against which bear springs for urging the annulus onto the clamping cone, the latter having at least one axial slot, so that the relative axial disposition of the annulus on the clamping cone-member changes its effective inner diameter, thereby controlling radial clamping pressure as exerted on a cable when inserted in the tubular and conical clamping member.

The annulus is slidably disposed in the sleeve but frictionally held therein. The socket member may have a recess receiving an O-ring for sealing against the cable. The conical clamping member has, preferably, a cylindrical end portion, which may be inserted into the recess to tension the sealing ring.

The double resilient bias, once by the sealing ring as acting against the clamping cone, and additionally by springs or the like, acting against the annulus, has the effect that the cone is already clamped against the cable during assembly of the connecting element, so that upon tightening axial thrust is exerted against the outer conductor, which will be urged against the socket element accordingly reinforcing contact between it and the conductor.

DESCRIPTION OF THE DRAWING

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The FIGURE is a cross-section through a plug connection for a coaxial cable in accordance with the preferred embodiment of the present invention.

Proceeding now to the detailed description of the drawings, a coaxial cable to be terminated in a plug has an inner conductor 10, an outer conductor 12, and a dielectric spacer and filling 16 is disposed between these conductors. The outer conductor may be constructed as an aluminum tube and is jacketed by a protective cover 14 made of a suitable plastic.

The plastic jacket is stripped off the cable for a certain length at its end and a cone 18, better called a trunkated cone with tubular interior, receives the bared end of the cable in intimate contact with outer conductor 12. A cylindrical or annular element 20 is connected to or integral with cone 18 and sits on conductor 12 accordingly.

Cone 18 has several slots in axial direction, one of them is continued through annulus 20, which can, therefore, be regarded as a split ring. The elements 18, 20 constitute a tubular clamping member, and due to the slot the clamping member can be rather easily slipped onto the cable end. Cone and ring have serrations or the like, i.e. surface roughness on the inside, where in contact with outer conductor 12.

A clamping annulus 24 with an inner conical surface coacts with cone 18 in that the two conical surfaces interface and engage. Annulus 24 is held inside of a sleeve 30, having an annular flange 28, and a pair of cup or plate springs are interposed between annulus 24 and flange 28. These springs, thus bear against the flange 28 and urge annulus 24 away from the flange onto cone 18.

In lieu of these springs 26 one can use a rubber ring having sufficient inherent elasticity for the desired purpose. In either case, resilient means are interposed between flange 28 and annulus 24 urging the latter to the right and onto the clamping cone 18 when the fitting and connector element is assembled.

Annulus 24 has an annular groove. The annulus itself is not too tightly held in sleeve 30, but an O-ring 34 in that groove bears frictionally against the inside of the sleeve to hold the annulus therein particularly before a head 32 is threaded into the sleeve, bearing in mind that annulus 24 is urged out of the sleeve by the springs 26.

Head 32 is a plug and socket element for electrical connection to the outer conductor 12 of the coaxial cable. The head or socket element is provided with an annular recess 33 having a sealing ring 36. Upon threading head 32 into sleeve 30, ring 36 is urged against annulus 20. Additionally, O-ring 36 bears against the outer conductor 12 when the cable end has been inserted. Since the head 32 is threadedly inserted in sleeve 30 and, therefor, is not axially displaced therein when assembly is completed, the two elements 24 and 18 are under oppositely oriented, resilient bias urging the two conical surfaces against each other.

For assembly, sleeve 30 is slipped over the cable end. Springs 26 are not compressed, so that annulus 24 has disposition more to the right than shown in the drawing. Next, clamping member 18/20 is inserted. Due to the splits, one traversing axially the clamping member entirely, this assembly can be slipped over the bared cable end rather easily. The apex portion of cone 18 is inserted into the annulus 24.

Next, the socket element is threaded into sleeve 30. At first, O-ring 36 engages the facing end of annulus 20 and the cone 18 is urged a little more into annulus 24. Socket element 32 is turned more and O-ring 36 begins to be compressed. However as soon as cone 18 is wedged into annulus 24, the slots in cone 18 begin to decrease in width reducing the radius of the inner cylindrical surface of tubular clamping member 18, 20, more so of 18, so that the clamping member is frictionally clamped against the outer conducor 12. Thus, the resilient interaction resulting from the advance of O-ring 36 and between it and assembly 18, 20 causes a radial clamping pressure to be exerted by annulus 24 upon cone 18. The drawings show the assembly at just about that point.

Upon further (axial) advance of head 32 by virtue of threaded insertion in sleeve 30 O-ring 36 is compressed until the front end 38 of head 32 abuts a (rear) stop surface 19 of cone 18. This will concur, or at least coincide approximately with abutment of a shoulder 40 with the axial end of outer conductor 12. At that point threaded advance of head 32 relative to the cable and the seated and clamped member 18, 20 should cease.

Finally, sleeve 30 is threaded onto head 32 whereby the springs 26 are fully compressed. Threaded advance of sleeve 30 greatly increases the clamping pressure exerted by spring biased annulus 24 against the cone 18. An axial thrust is exerted here on the cable end and particularly upon the outer conductor 12 urging its front end into more positive engagement with shoulder 40 of head 32, so that the contact between socket 32 and outer conductor is significantly enhanced.

The final disposition finds springs 26 almost completely compressed and cone 18 is strongly urged into frictional contact with outer conductor 12. The front end of head 32 abuts annulus 20, which is actually completely pushed into the recess of head 32. The tension of the compressed springs 26 is quite high, so that loosening of the wedge lock is prevented. If, for example, some of the material of conductor 17 begins to yield and to flow, immediate clamping action by tubular member 18, 20 may be relaxed, but the strong pressure exerted by springs 26 onto annulus 24 will tend to offset any relaxation in clamping pressure. If the springs 26 are very strong it may be advisable not to compress them completely initially; a later tightening will permit compensation for any relaxation as it may have occurred.

The invention is not limited to the embodiments described above but all changes and modifications thereof not constituting departures from the spirit and scope of the invention are intended to be included.

I claim:

1. Socket connection with a coaxial cable having an inner and outer conductor, comprising:

a sleeve; an annulus with inner conical surface, axially movably disposed in the sleeve;

a hollow, externally conical member of variable inner diameter for receiving and disposition on the outer conductor and coacting with the annulus to clamp the conical member onto the outer conductor;

the annulus and the conical member remaining axially movable relative to each other inside of the sleeve except for the engagement of the conical surfaces;

spring means in the sleeve acting against the annulus and urging the annulus onto the conical member for reducing its diameter and clamping action thereon, the spring being sufficiently strong so that it continues to shift the annulus onto the conical member due to being axially movable, and to thereby supply the clamping force exerted by the conical member upon the outer conductor even after yielding of the outer conductor as a result of such clamping action;

a socket element in electrical contact with the outer conductor and connected to the sleeve, the socket element having an annular recess; and a sealing ring in the recess bearing against the outer conductor and against the conical member at one end thereof, said end facing axially away from the annulus.

2. Socket connection as in claim 1, the sleeve having a flange on one end, the socket element being threaded to the other end, the spring means bearing against the flange as well as against the annulus, the annulus being slidably retained in said sleeve.

3. Socket connection as in claim 1, the annulus having a groove facing the inside of the sleeve; and an O-ring in the groove to provide frictional connection between the annulus and the sleeve.

4. Socket connection as in claim 1, the conical member having serrations on the inside.

5. Socket connection as in claim 1, the conical member having at least one axial slot for changing its effective inner diameter in dependence upon relative axial position of the annulus.

6. Connector element and termination for coaxial cable comprising:

a hollow tubular conical clamping member for slipping over and receiving the cable;

an annulus with inner conical surface;

a sleeve with threaded end and containing the annulus as well as the clamping member and positioning the annulus for coacting with the clamping member, said annulus and said member being movably disposed in the sleeve; first resilient means biasing the clamping member axially in a first direction against the annulus; and second resilient means being spring means which includes at least one plate spring, for biasing the annulus axially;

said annulus remaining movable in the sleeve except for engagement with said member while being biased by the second resilient means in a direction opposite to the first direction against the clamping member, said first and second resilient means being sufficiently strong so that the resulting force urging the annulus and the member towards each other continues to shift the annulus onto the conical member due to being axially movable, and to thereby provide the clamping force and action exerted by the member upon the cable even after yielding of said cable as a result of such clamping action.

7. Connector element as in claim 6, wherein the first resilient means is a sealing ring, providing additionally sealing against the cable when inserted in the clamping member.

8. Connector element as in claim 6, wherein at least one of the resilient means as an O-ring.

* * * * *